United States Patent [19]

Ritzerfeld

[11] 4,354,757

[45] Oct. 19, 1982

[54] XEROGRAPHIC OR ELECTROSTATIC COPYING APPARATUS CAPABLE OF COPYING ONLY SELECTED LINES, PARAGRAPHS OR OTHER SUCH SECTIONS OF AN ORIGINAL

[76] Inventor: Gerhard Ritzerfeld, Schorlemer Allee 14, 1000 Berlin 33, Fed. Rep. of Germany

[21] Appl. No.: 737,564

[22] Filed: Nov. 1, 1976

[30] Foreign Application Priority Data

Oct. 30, 1975 [DE] Fed. Rep. of Germany ..... 2548836

[51] Int. Cl.[3] ..... G03G 15/04; G03G 15/052

[52] U.S. Cl. ..... 355/7; 355/3 R; 355/14 R

[58] Field of Search ..... 355/3 R, 3 TR, 4, 7, 355/14, 69, 71, 133

[56] References Cited

U.S. PATENT DOCUMENTS

| | | | |
|---|---|---|---|
| 3,109,355 | 11/1963 | Ritzerfeld et al. | 355/7 |
| 3,860,338 | 1/1975 | Reehil | 355/7 X |
| 3,914,043 | 10/1975 | McVeigh | 355/4 |
| 3,967,894 | 7/1976 | Tsilibes | 355/4 |
| 4,008,954 | 2/1977 | Ogawa et al. | 355/3 R X |

*Primary Examiner*—Fred L. Braun

*Attorney, Agent, or Firm*—Michael J. Striker

[57] ABSTRACT

An original to be copied is laid face down upon a transparent support. A light-sensitive semiconductor element moves through a charging station, an expsoure station at which the element is discharged by incident image light from the illuminated original, a developing station, and an image transfer station at which the developed image on the element is transferred to copy paper. Lines, paragraphs, or other such sections on the original are selected for copying. An auxiliary discharging arrangement is operative for discharging those sections of the semiconductor element corresponding to non-selected sections on the original as such sections of the semiconductor element move through a blanking-out location intermediate the charging arrangement and the developing arrangement. The operation of the auxiliary discharging arrangement is controlled by a control arrangement which coordinates the electrostatic blanking out of sections of the semiconductor element with the earlier selection of the lines, paragraphs or other such sections of the original to be copied. The selection of lines, paragraphs or other such sections on the original for copying can be changed at will with respect to number, size, location and combinations.

1 Claim, 8 Drawing Figures

XEROGRAPHIC OR ELECTROSTATIC COPYING APPARATUS CAPABLE OF COPYING ONLY SELECTED LINES, PARAGRAPHS OR OTHER SUCH SECTIONS OF AN ORIGINAL

BACKGROUND OF THE INVENTION

The invention relates to xerographic or electrostatic copying apparatuses of the type which produce copies from an original whose image consists of lines of print, paragraphs, or other such sections. More specifically, the invention relates to copying apparatuses of the type capable of producing a copy of only selected lines, paragraphs or other such sections of the original. Typically, such copying apparatuses are comprised of a transparent support surface onto which the original is laid face down. The original is illuminated, and light from the original is projected onto an electrostatically charged light-sensitive surface to effect image-dependent discharge of the surface, and accordingly produce an electrostatic image of the original. The electrostatic image is developed to form a visible image. Possibly also, the visible image on the light-sensitive surface is then transferred onto copy material, and the image on the copy material is then fixed.

A known rotary duplicator machine of the type in question is capable of copying only selected portions of the text on an original to be copied. The original is scanned by scanning light and the light from the scanned original is projected onto an electrostatically charged semiconductor surface. The resulting electrostatic image is thereupon developed in preparation for printing. The illumination of the original and the projection of image light upon the semiconductor surface proceed in a line-by-line manner. After light corresponding to one line of the original has been projected onto a corresponding strip of the charged surface, the copying drum is indexed a distance corresponding to one line, whereupon the projection of image light from the next line to be copied from the original occurs. The requisite step-by-step advancement of the semiconductor surface and the corresponding step-by-step exposure operation involves considerable expense for the necessary mechanisms and control circuitry. It is very difficult to incorporate such means into existing copying apparatuses or copying apparatus designs. Additionally, this prior-art expedient greatly slows down the rate at which copying can proceed. Also, the known expedient involves a troublesome rotary return movement of the semi-conductor surface.

SUMMARY OF THE INVENTION

It is a general object of the invention to provide a copying apparatus capable of producing a copy of only selected lines, paragraphs and/or other such sections of an original to be copied, involving relatively little modification of conventional copying apparatus designs and affording a line- or paragraph-selection capability which does not detract from the speed at which copying operations can be performed.

These objects, and others which will become more understandable from the description of preferred embodiments can be met, according to one advantageous concept of the invention, by providing an auxiliary discharging arrangement which effects discharging by projecting light onto the electrostatically charged surface at a location intermediate the charging station and the developing station of the copying apparatus. The auxiliary discharging arrangement is controlled by a control arrangement which causes the discharging arrangement to electrostatically blank out those sections of the charged surface corresponding to the sections of the original ahead of, subsequent to and/or intermediate the lines, paragraphs or other such sections selected for actual copying. The electrostatic blanking out is effected by illuminating those sections of the charged surface which are to be blanked out. The lines, paragraphs or other such sections selected for copying, and accordingly the spaces ahead of, behind and intermediate them, can be selected of different sizes, number and location, and the selection can be changed as desired. Successive portions of the developed electrostatic image are transferred onto successive portions of a copy paper as the latter moves through an image transfer station. Advantageously, the transport of the copy paper through the image transfer station is interrupted during each of the intervals during which one of the electrostatically blanked out sections of the light-sensitive semiconductor surface moves through the image transfer station. Such transport interruption is effected by a control arrangement which controls the copy paper transport means.

Advantageously, the copying apparatus is provided with an auxiliary discharging arrangement which effects discharge by exposing the light-sensitive surface to light. The auxiliary discharging arrangement effects such discharge at a location intermediate the charging station and the developing station of the copying apparatus. A control arrangement controls the auxiliary discharging arrangement and causes the latter to blank out, by means of auxiliary light exposure, those sections of the light-sensitive semi-conductor surface corresponding to the sections on the original located ahead of, behind or intermediate the lines or paragraphs selected for copying. The locations and number of lines or the locations and sizes of the paragraphs to be copied can be selected at will. During the passage of the light-sensitive surface through the image transfer station, at which the developed image is transferred to the copy paper, the transport of the copy paper through the image transfer station is interrupted each time one of the electrostatically blanked out sections of the light-sensitive surface, corresponding to differently positioned and sized lines, line groups and/or paragraphs, is passing through the image transfer station.

The auxiliary discharging arrangement can be located to effect electrostatic blanking out at a location intermediate, on the one hand, the location at which the image light from the original is projected onto the light-sensitive surface and, on the other hand, the developing station of the copying apparatus. The auxiliary discharging arrangement effects discharge by exposing the light-sensitive surface to light. It can comprise essentially a light source which is automatically energized and de-energized by a control arrangement in correspondence to the lines, paragraphs or other sections which have been previously selected for copying. Alternatively, the auxiliary discharging arrangement can be essentially comprised of a light source and a controllable shutter arranged in front of the light source. In that case, the control arrangement would correspondingly control the opening and closing of the shutter.

As another possibility, the auxiliary discharging arrangement can be located to effect electrostatic blanking out at a location intermediate the charging arrangement for the light-sensitive surface and the location at which image light from the original is projected onto the light-sensitive surface.

As a further possibility, the auxiliary discharging arrangement can be located to introduce auxiliary exposure light into the path of the image light travelling from the original to the light-sensitive surface. In that event, it is advantageous to introduce the auxiliary light into the path of the image light by means of a semitransmissive mirror. The auxiliary light is introduced into the image light path by transmission through the mirror, whereas the image light is reflected by the mirror towards the light-transmissive surface, or vice versa.

Upstream of the transfer station, at which the developed image is transferred from the light-sensitive surface of the copy paper, there is provided an arrangement of copy paper transport rollers. The aforementioned interruption of the transport of the copy paper through the image station is effected by separating cooperating ones of the transport rollers during the time intervals during which electrostatically blanked out sections of the light-sensitive surface are travelling through the image transfer station. One of the transport rollers can be mounted for swinging movement into and out of a position in which it presses against a cooperating transport roller, with the swinging movement being controlled by means of electromagnets, control cams, or the like.

According to one advantageous concept of the invention, simultaneously with the swinging of one transport roller away from the other, a holding device for positively preventing copy paper transport swings into operative position, and a pressing means otherwise operative for pressing the copying paper against the light-sensitive surface moves to inoperative position. Alternatively, the copy paper transport can be effected using a controllable coupling between one of the transport rollers and a drive therefor, with the transport interruption being effected by disengaging the coupling.

Advantageously, to effect transfer of the developed electrostatic image on the light-sensitive surface to the copy paper, use can be made of a pressing element charged to a polarity opposite that of the light-sensitive surface. The pressing element normally presses the copy paper against the light-sensitive surface. The copy paper transport interruption which occurs during passage of blanked out portions of the light-sensitive surface through the image transfer station can be effected by causing an electromagnet or a control cam to swing the pressing element away from the light-sensitive surface.

The operation of the light source, or of the shutter in front of the light source, of the auxiliary discharging arrangement is controlled by a control arrangement. The control arrangement preferably responds to synchronizing signals. As the light-sensitive surface moves, e.g., as the drum provided with such surface rotates, synchronizing signals are generated in correspondence to the rate at which successive lines, paragraphs or other such sections are produced in the form of an electrostatic image on the light-sensitive surface. These synchronizing signals are applied to one or more counters. The counter(s) are provided with selector inputs to which signals are applied by means of one or more selector switches. The selector switches are settable to effect selection of the lines, paragraphs or other such sections to be copied. The counter(s) effect counting of the synchronizing signals. When counts corresponding to the setting of the selector switches are reached, a signal is generated for energizing the light source or opening the shutter of the auxiliary discharging arrangement and/or for interrupting transport of the copy paper through the image transfer station.

According to a preferred embodiment, two counters are employed, one associated with the auxiliary discharging arrangement, the other associated with the means for interrupting copy paper transport. When the light-sensitive surface begins to move at the start of a copying operation, the synchronizing signals which are generated are applied only to the first counter. The synchronizing signals become applied to the second counter only after a predetermined number of synchronizing signals have been generated, whereupon the second counter begins to count. The predetermined number of synchronizing signals corresponds to the distance which each section of the light-sensitive surface must travel in going from the auxiliary discharging arrangement to the image transfer station. The first counter activates the auxiliary discharging arrangement each time one of the preselected counts is reached, and the second counter does so also. However, because of the delay in the application of synchronizing signals to the second counter, the copy paper transport interruption corresponding to each electrostatic blanking out occurs delayed with respect to the blanking out by a time interval corresponding to that required for the blanked out section of the light-sensitive surface to actually reach the image transfer station.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DESCRIPTION OF THE PREFERRED EMBODIMENTS

Figure 1:
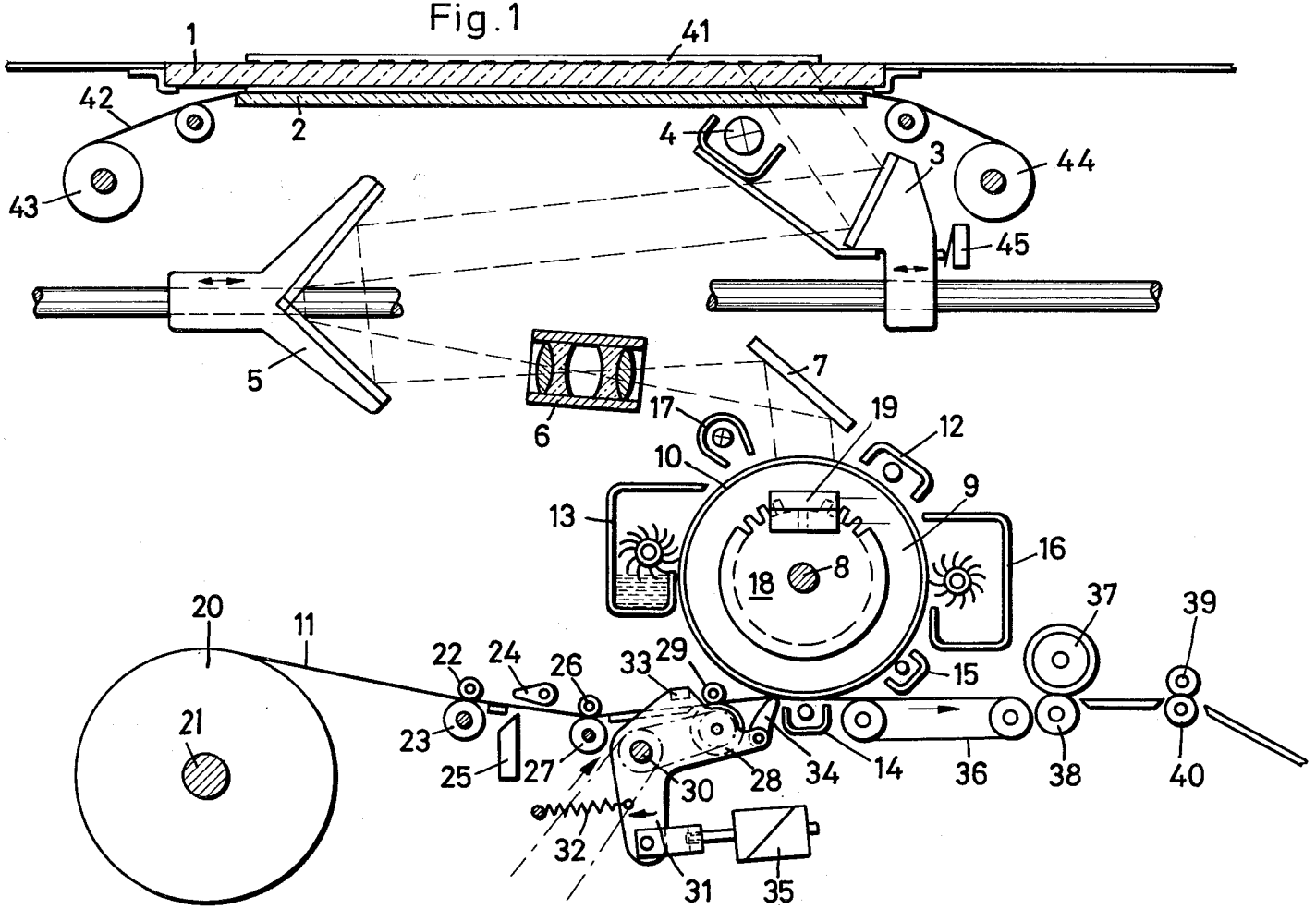
FIG. 1 depicts a xerographic copying apparatus provided with an auxiliary discharging arrangement and a controllable copy paper transport arrangement.

In the copying apparatus depicted in FIG. 1, glass plates 1 and 2 serve as the support surface for an original 41 to be copied. Arranged beneath glass plates 1 and 2 is a mirror 3 which in per se known manner shifts in direction parallel to the support surface during a copying operation. Fixedly connected to mirror 3 is a light source 4. A double mirror 5 is likewise horizontally shiftable and twice reflects the image light coming from the mirror 3. The shifting movement of the double mirror 5 is synchronized with that of the single mirror 3. The light reflected from double mirror 5 passes through an objective 6 and is reflected by a further mirror 7. Mirror 7 reflects the image of the scanned originals and/or masks at the support surface onto a section of a drum 9. Drum 9 rotates counterclockwise on its shaft 9 and is provided with a selenium coating 10. Arranged about the drum 9, for the production of a toner image of the scanned originals on the selenium coating 10 and for the transfer of the toner image to the copy paper 11, are a charging arrangement 12, a toner applying arrangement 13, a reverse charging arrangement 14 for effecting the transfer of the toner image, a discharging arrangement 15, as well as a cleaning arrangement 16 for the removal from the selenium coating 10 of residual toner particles. Facing the selenium coating 10, between the location at which the illuminated image is transferred onto the selenium coating 10, on the one hand, and, on the other hand, the toner applying arrangement 13, is an additional discharging arrangement 17, here constituted by a light source. Rotating in unison with the drum 9 is a synchronizing disk 18 which cooperates with a sensing head 19 in the production of synchronizing pulses. The synchronizing pulses, in a manner described below, are utilized in controlling the discharging arrangement 17 and the transport of the copy paper 11.

The copy paper 11 is stored in the form of a roll 20 on a rotatable shaft 21 and is pulled off by means of driven rollers 22 and 23, the shaft 21 being lightly braked against rotation. The copy paper 11 is fed to a cutting arrangement comprised of a rotating knife 24 and a stationary knife 25. Further transport rollers 26, 27 feed the severed copy sheet to a transport arrangement comprised of an uninterruptedly driven roller 28 and a counterpressure roller 29. The roller 28 is mounted at its axial ends on levers 31 both of which are pivotable about a shaft 30. A tension spring 32 pulls upon the levers 31 to urge the roller 28 away from the counterpressure roller 29 and accordingly disable transport of the copy sheet. Simultaneously, a braking element 31 mounted on the levers 31 is pressed against the copy sheet when the latter is located between the rollers 28 and 29. The levers 31 additionally carry a pressing element 34 by means of which copy sheets transported to the drum 9 are pressed against the selenium coating 10. An electromagnet 35 is coupled to the levers 31. When electromagnet 35 becomes energized, the roller 28 is swung against the counterpressure roller 29 and the braking element 33 is lifted off the copy sheet so that the latter can be transported to the drum 9. The electromagnet 35 like the discharging arrangement 17 is controlled using the synchronizing pulses generated by sensing head 19.

The copy sheet is pressed by pressing element 34 against the selenium coating 10 and is transported past the reverse charging arrangement 14. The latter effects the transfer of the toner image from the selenium coating 10 to the copy sheet. The copy sheet is then transported by a conveyor belt 36 to two transport rollers 37, 38. The upper transport roller 37 is heated and effects a fusing of the toner image on the copy sheet. Additional transport rollers 39, 40 deliver the copy sheet to the discharge station of the copying apparatus.

Lying upon the glass plate 1 is an original 41 to be illuminated. Original 41 is printed with lines of print which extend normal to the plane of FIG. 1. Passing through the space intermediate glass plates 1 and 2 is a mask belt 42 supported upon spools 43 and 44 located at opposite sides of the support surface. To shift the mask belt 42 into any desired position relative to the original 42, the spools 43, 44 are coupled to a non-illustrated controllable drive motor. Mask belt 42 is transparent and bears a succession of different form items. The form items may for example include form paragraphs to be superimposed upon the data on the face of the original 41 to form with the latter the complete image to be copied, or may be headings, decorative borders, or the like.

The operation of the additional discharging arrangement 17 and of the controllable transport arrangement for the copy paper will be described in more detail with repect to FIG. 7. The original 41 bears lines of print A, B, C, . . . all of which could be projected onto the selenium coating 10 of drum 9 at the locations shown in FIG. 7. However, in the present instance, let it be assumed that only the lines of print A, B, C and G are to be copied. Accordingly, the discharging arrangement 17, in a way described below, is controlled in such a manner that the locations on the selenium coating 10 corresponding to the remaining lines D, E, F, H, I, K, . . . are completely exposed and therefore after being charged by charging arrangement 12 are discharged again. Accordingly, a toner image of only lines A, B, C and G is produced on the selenium coating 10. The illustrated transport arrangement for the copy paper causes the gap produced by the not copied lines D, E and F between the lines C and G to be bridged over, so that on the copy paper the line G will immediately follow the line C without any gap.

To this end, the transport arrangement is controlled in such a manner that transport of the copy sheet occurs only when a toner-image-bearing line on the selenium coating 10 moves past the reverse charging arrangement 14; the transport of the copy sheet is interrupted when due to the action of the discharging arrangement 17 the lines moving past the reverse charging arrangement 14 bear no toner image.

A switch 45 depicted in FIG. 1 is briefly activated during each copying operation by the mirror 3 as the latter returns to its starting position. As a result, the control circuit for the discharging arrangement and the transport arrangement for the copy paper are activated in such a manner that the lines to be copied off of the original are automatically selected after each copying operation; e.g., successive copies respectively bear successive ones of the lines from original 41.

The drive motor for the transport rollers 22, 23 is controlled by manually activated switches, preferably in dependence upon the number of lines to be copied, in such a manner that the length of the individual copy sheet severed from the copy paper strip is matched to the space requirement established by the line selection.

Figure 2:
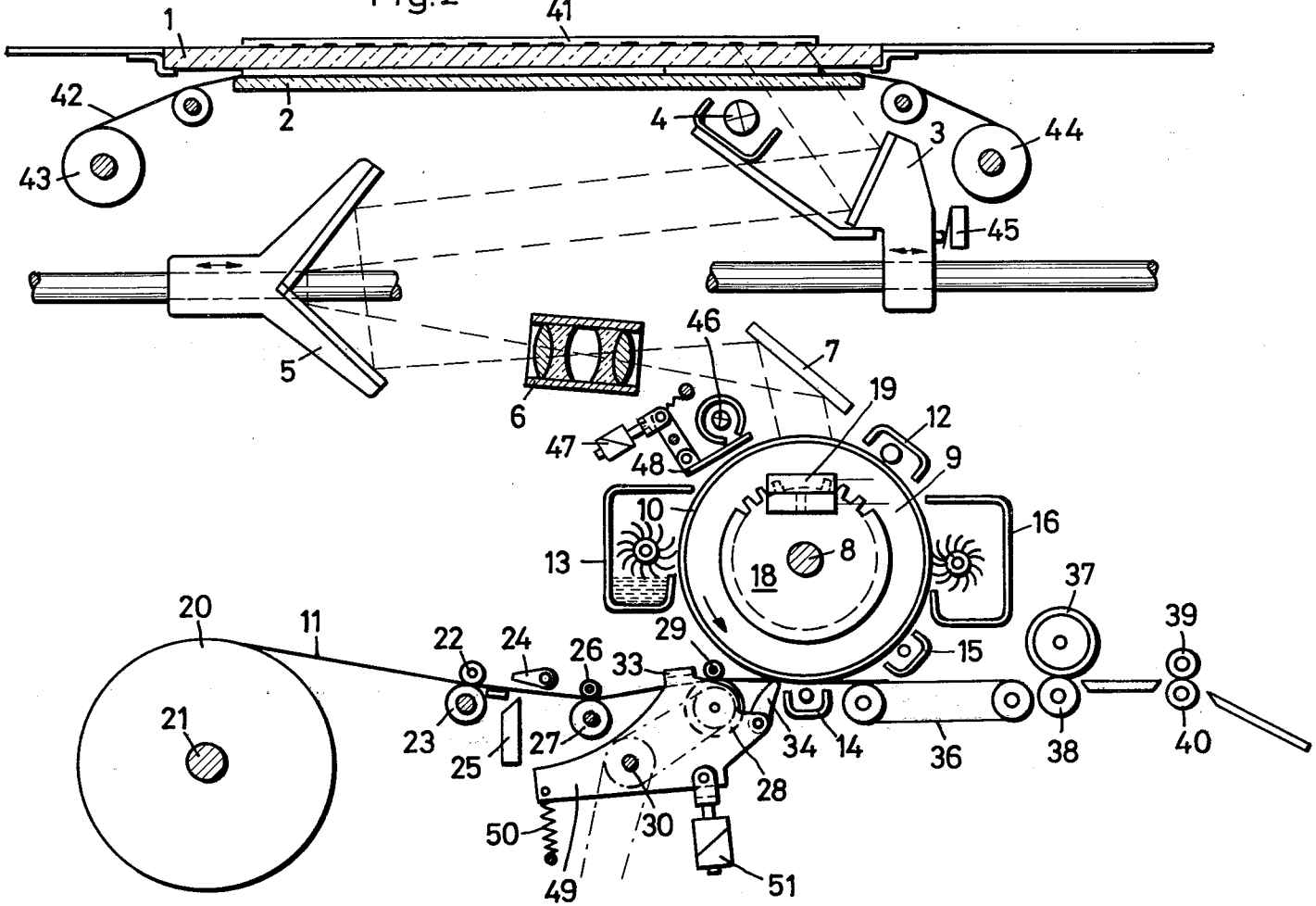
FIG. 2. depicts a copying apparatus with differently designed auxiliary discharging and transport arrangements.

The copying apparatus shown in FIG. 2 corresponds to that of FIG. 1, but the discharging arrangement and the transport arrangement for the copy sheets are differently designed. The discharging arrangement in FIG. 2 is comprised of an uninterruptedly energized light source 46 and an apertured light shield 48 which can be pivoted by means of an electromagnet 47. In dependence upon the setting of shield 48, the narrow section on the selenium coating 10 located directly opposite the light source 46 and extending over the full axial length of the drum 9 is either illuminated or not illuminated. The control of electromagnet 47 is effected in a manner analogous to that of the discharge arrangement 17 in FIG. 1. The roller 28 and the braking element 33 are mounted on levers 49 which are pivotable about a shaft 30. A tension spring 50 urges the roller 28 to swing against the counterpressure roller 29. An electromagnet 51 when energized causes the roller 28 to swing away and the braking element 33 to become operative.

Figure 3:
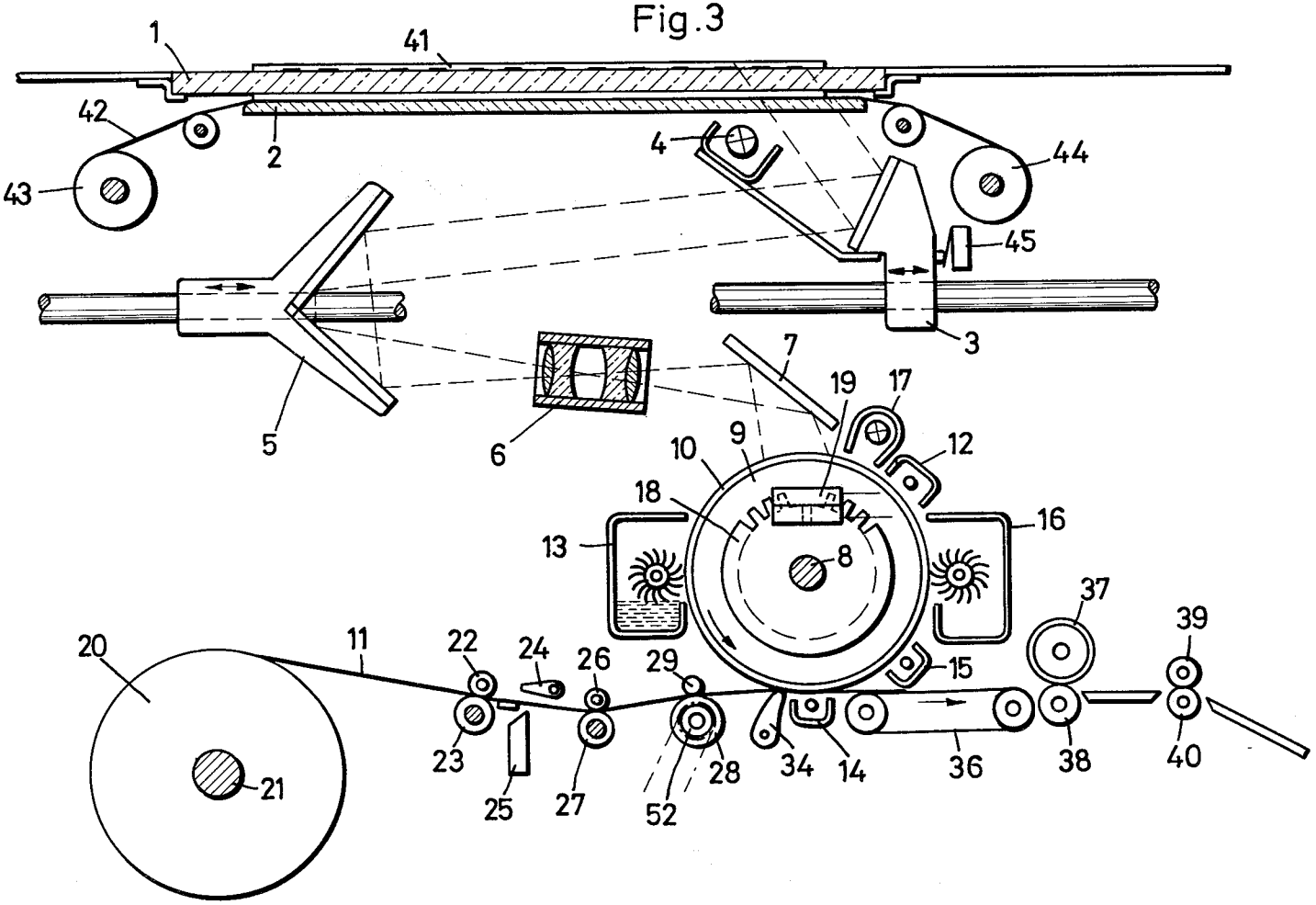
FIG. 3 depicts a copying apparatus with a third form of auxiliary discharging and transport arrangements.

The copying apparatus depicted in FIG. 3 is provided with a roller 28 which is not mounted on swingable levers but instead is stationarily journalled. It is driven through the intermediary of a controllable coupling 52. The control of coupling 52 is effected in a manner corresponding to the control of the swinging motion of levers 31 or 49. An additional braking element is not necessary, because the copy sheet is held by the roller 28 itself when the latter is not being driven. The discharge arrangement 17 is located between the charging arrangement 12 and the location at which the illuminated image is projected onto the selenium coating 10. Accordingly, an electrostatic latent image is prevented even from being formed on those sections of selenium coating 10 corresponding to the lines which are not to be copied.

Figure 4:
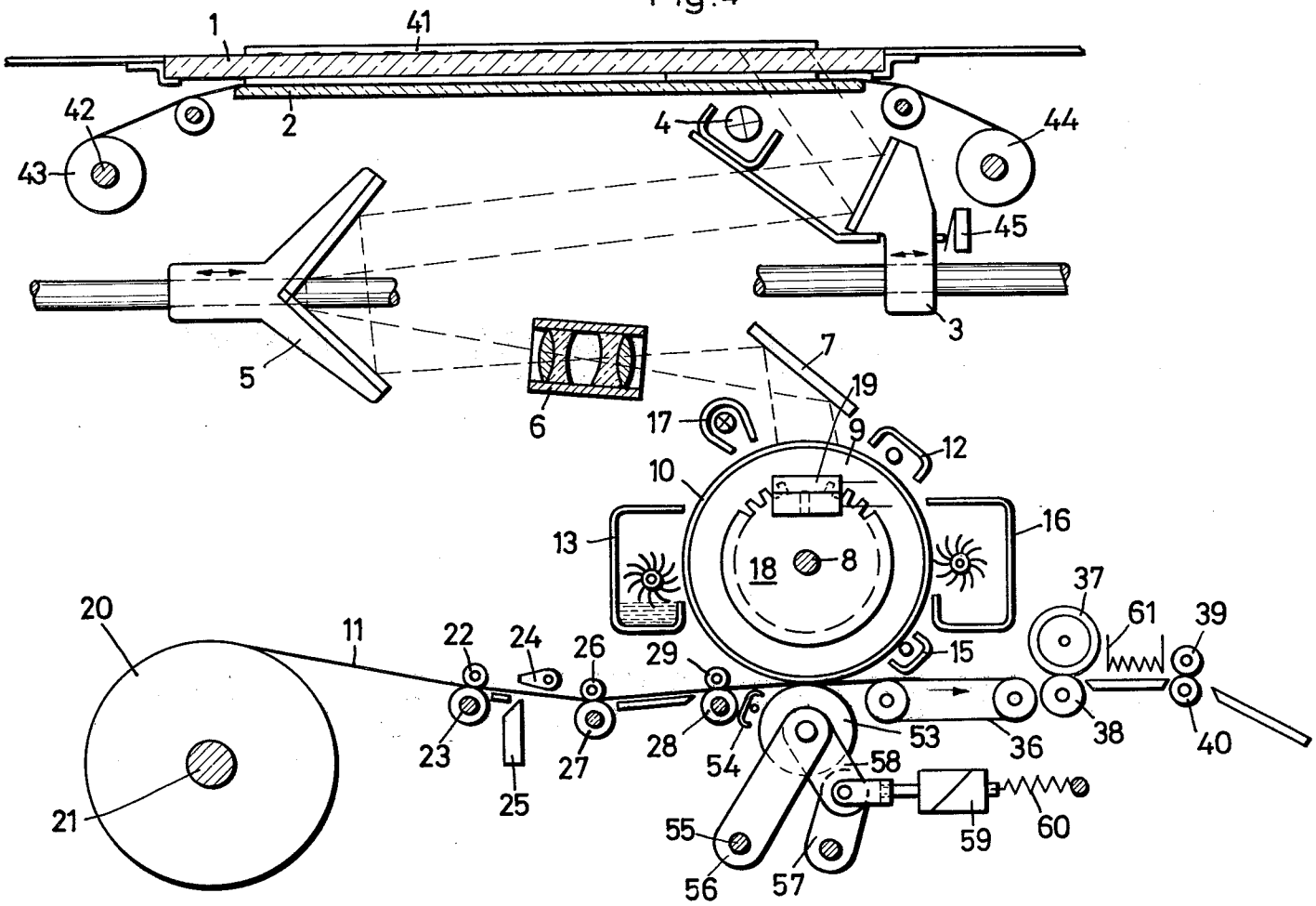
FIG. 4 depicts a copying apparatus incorporating a copy paper transport arrangement of still different design.

In the copying apparatus depicted in FIG. 4, the control of the transport of the copy sheet is effected not by means of roller 28, but instead by means of a counterpressure roller 53 which can be swung against the drum 9. Roller 53 receives from a charging arrangement 54 a charge opposite to the charge on the selenium coating 10, so that when it is swung against roller 9 it effects not only transport of the copy sheet, but also the transfer of the toner image to the copy sheet. The charging arrangement can be arranged within the counterpressure roller. The counterpressure roller 53 is mounted at its axial ends in levers 56 pivotable about a shaft 55. Swinging of roller 53 is effected by means of an elbow linkage comprised of two levers 57, 58, the middle pivot of which is coupled to the armature of an electromagnet 59. A tension spring 60 is connected to the armature of electromagnet 59 in such a manner that when the electromagnet is not energized the counterpressure roller 53 is swung away from drum 9 and when the electromagnet 59 is energized it is swung against the drum 9. Located behind the heated transport roller 37 is a further heating arrangement 61 provided to assure a reliable fixing of the toner image even at high copy sheet transport speeds.

Figure 5:
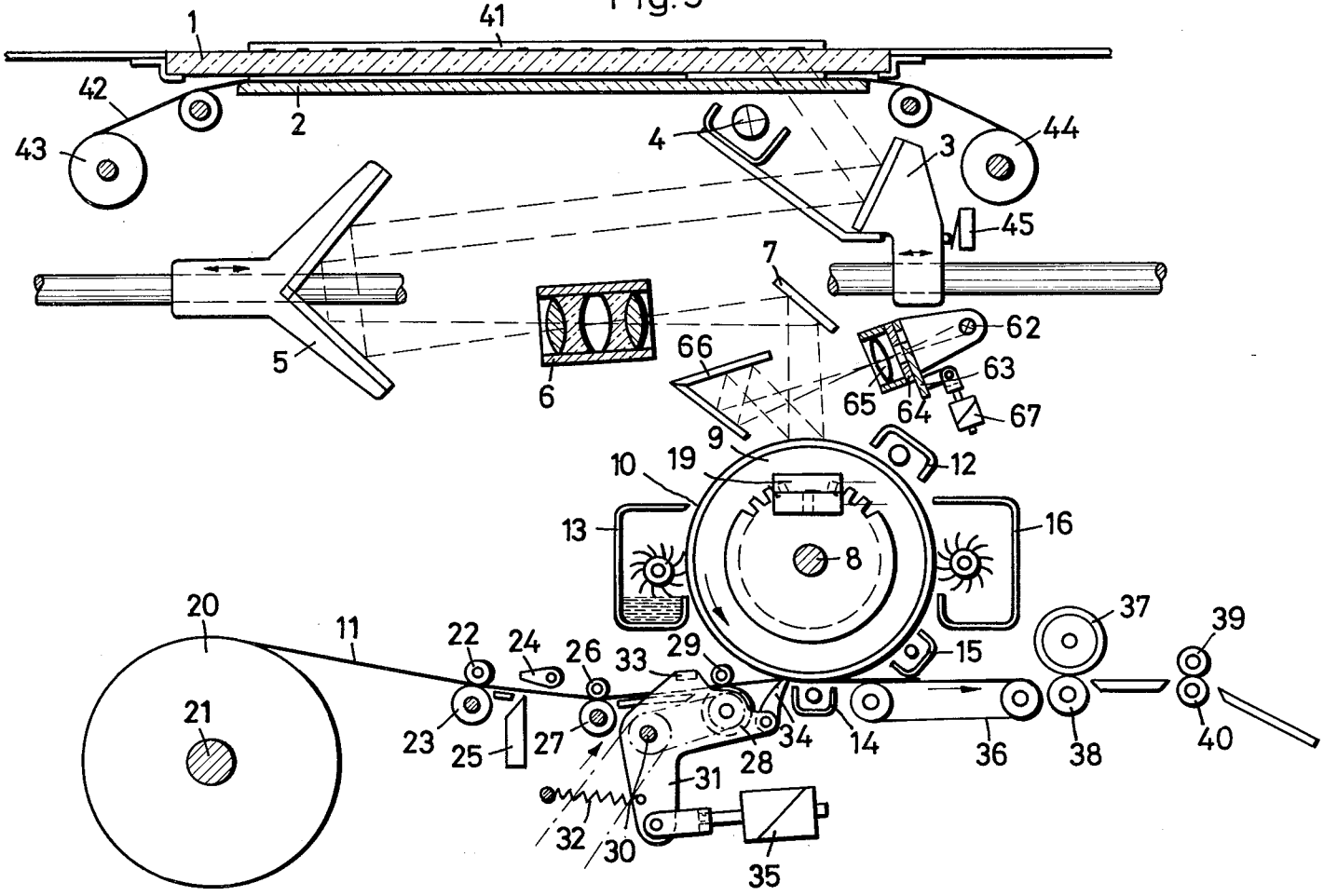
FIG. 5 depicts a copying apparatus provided with an auxiliary discharging arrangement different from the others illustrated.

FIG. 5 depicts another design for the additional discharging arrangement. Here, the discharge-producing light is projected toward the same locations on the selenium coating 10 as is the actual image light, and simultaneously therewith. If the discharging arrangement has been activated, the formation of an electrostatic latent image at such location will be prevented. The discharging arrangement is comprised of a light source 62, two apertured shields 63, 64 arranged one behind the other, an objective 65 and a double mirror 66. The apertured shield 63 is shiftable by an electromagnetic 67 in such a manner that, when the electromagnet is energized, the apertures of shields 63, 64 register and light can pass through; when the electromagnet is not energized, the apertures in shields 63, 64 are offset relative to one another and the light from source 62 is blocked.

Figure 6:
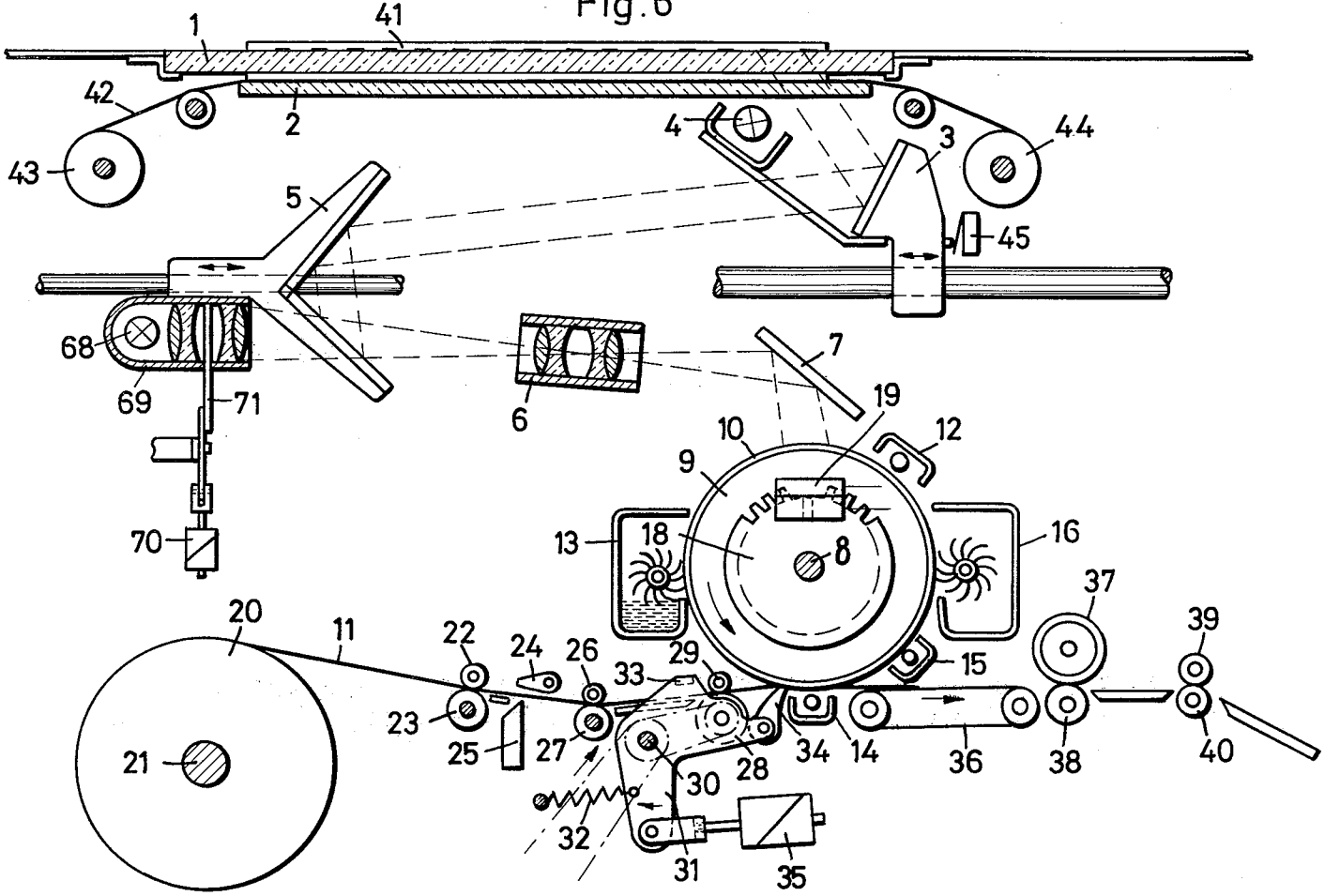
FIG. 6 depicts a copying apparatus showing still another version of the auxiliary discharging arrangement.

In the copying apparatus depicted in FIG. 6, the light rays from the additional discharging arrangement are introduced directly into the image light path extending from the original 41 to the selenium coating 10. The lower part of the double mirror 5 is to this end designed as a semitransmissive mirror capable of both reflection and transmission. The light emitted from a light source 68 passes to the selenium coating 10 via an objective 69, the double mirror 5, the objective 6 and the mirror 7. A shutter 71 pivotable by an electromagnet 70 either blocks or unblocks the path of light within the objective 69. If the light path is unblocked, then here likewise even the formation of an electrostatic latent image corresponding to the scanned lines on original 41 is prevented. The arrangement comprised of light source 68, objective 69, electromagnet 70 and shutter 71 is mounted on the double mirror 5 and shares the shifting movement of the latter.

Figure 8:
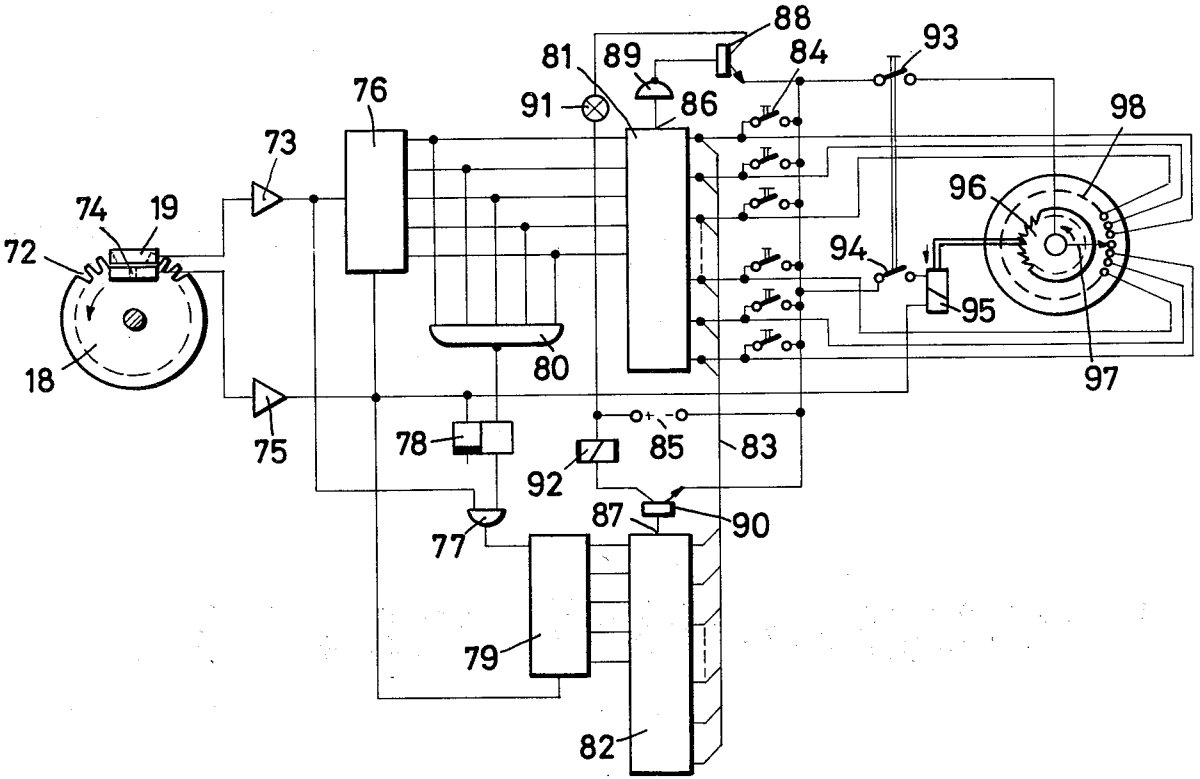
FIG. 8 depicts a control circuit for controlling the operation of the auxiliary discharging arrangement and the copy paper transport arrangement.

FIG. 8 depicts a circuit arrangement for the control of the light source of the discharging arrangement and the transport arrangement for the copy sheets, e.g., for the copying apparatus depicted in FIG. 1. The synchronizing disk 18, which shares the rotation of drum 9, is provided on its periphery with sixty-four slits 72, so that for one rotation of the synchronizing disk 18 a corresponding number of synchronizing pulses is generated by the upper unit of sensing head 19 and applied to an amplifier 73. A further slit 74 located more radially inward on the synchronizing disk 18 cooperates with the lower unit of sensing head 19 in such a manner that a corresponding synchronizing pulse is generated and applied to an amplifier 75 once per rotation of the disk, i.e., each time the latter returns to its starting position. The copying apparatus is for example so designed that the image of the original 41 is projected onto one half the peripheral surface of the drum 9. It will be assumed that original 41 bears thirty-two lines, which are to be selected for copying in any desired combination. The output pulses from amplifier 73 are applied to a pulse counter 76 capable of counting up to thirty-two and also to one input of an AND-gate 77. The other input of AND-gate 77 is connected to the output of a flip-flop 78. The pulse generated in response to slit 74 sets the flip-flop 78 to a state in which it prevents AND-gate 77 for transmitting the output pulses from aplifier 73, so that these pulses cannot reach a further pulse counter 79 likewise operative for counting up to thirty-two. When synchronizing disk 18 is set into motion and turns out of its starting position, the resulting synchronizing pulses are initially applied only to the pulse counter 76. When, after one half rotation of synchronizing disk 18, counter 76 has reached the count thirty-two, a NAND-gate 80 whose inputs are connected to the outputs of pulse counter 76 causes the flip-flop 78 to undergo a change of state. Subsequently generated synchronizing pulses are now applied via the AND-gate 77 to the pulse counter 79, as well. After a further half rotation of the synchronizing disk 18, the latter returns to its starting position, and a pulse corresponding to slit 74 resets the pulse counters 76, 79 and furthermore causes flip-flop 78 to revert to that one of its states in which the AND-gate 77 is disabled.

The outputs of pulse counters 76, 79 are connected to respective ones of data selectors 81, 82. Each data selector 81, 82 has thirty-two selecting inputs. A line 83 connects corresponding selecting inputs of the two data selectors 81, 82 to each other and also to respective ones of a plurality of selector switches 84. Each of the thirty-two selector switches 84 is associated with one line on the original 41. Closing of one or a plurality of the switches 84 causes the corresponding lines on the original 41 to be copied.

Specifically, assume that one selector switch 84 is closed. As a result, a definite potential, i.e., the potential of the negative terminal of voltage source 85, is applied to the corresponding two selecting inputs of data selectors 81 and 82. As the drum 9 and synchronizing disk 18 rotate, pulses are applied to counters 76, 79 and their count, as represented by the combination of signals on their outputs, increases progressively. When the count of either counter reaches a value corresponding to the one selector switch 84 which has been closed, a signal is generated on the auxiliary output 86 and 87 of the data selector 81 or 82. In the case of data selector 81, such output signal, via a NOT-circuit 89, renders non-conductive an otherwise conductive transistor 88; in the case of data selector 82, such output signal renders conductive an otherwise non-conductive transistor 90. Connected in the collector-emitter path of transistor 88 is the light source 91 of the additional discharging arrangement; connected in the collector-emitter path of transistor 90 is an electromagnet 92 whose state of energization determines whether copy sheet transport occurs or not.

Thus, the closing of one selector switch 84 causes the light source 91 of the additional discharging arrangement to be extinguished as the section of the selenium coating 10 corresponding to the line selected for printing moves past the additional discharging arrangement; accordingly, the electrostatic latent image of the selected line on this section of selenium coating 10 will not be discharged when moving past the additional discharging arrangement. As a further result of the closing of one selector switch 84, when the section of the selenium coating 10 corresponding to the selected line moves through the toner-image transfer station, the copy sheet will not be kept stationary but instead will be transported a distance corresponding to one line.

The offset in the start of counting by the two pulse counters 76, 79 takes into account the separation in space between the discharging arrangement and the transfer station. In the embodiment of FIG. 8, this distance corresponds to one half rotation of the drum 9. If the distance in question does not correspond to one half of one drum rotation, then the change of state of the flip-flop 78 is effected when the appropriate count is reached, under the control of a decoding arrangement connected to the outputs of the pulse counter 76.

It may be desired that the lines to be copied be automatically selected in such a manner that successively produced copies will bear images of respective successive ones or groups of the lines on original 41. In that event, ganged switches 93, 94 are manually closed. After each complete rotation of the synchronizing disk 18, the pulse corresponding to disk slit 74 effects brief energization of an electromagnet 95. This results in activation of a step-by-step switching mechanism. Specifically, a contact arm 97 connected to a switching disk 96 swings from one to the next contact in a circular contact row 98. Each contact in contact row 98 is associated with one of the selector switches 84. If the contact arm 97 engages one of these contacts, then the respective switch 84 is by-passed and the corresponding line on the original is thereby selected for copying, without the selector switch 84 ever actually closing.

Figure 7:
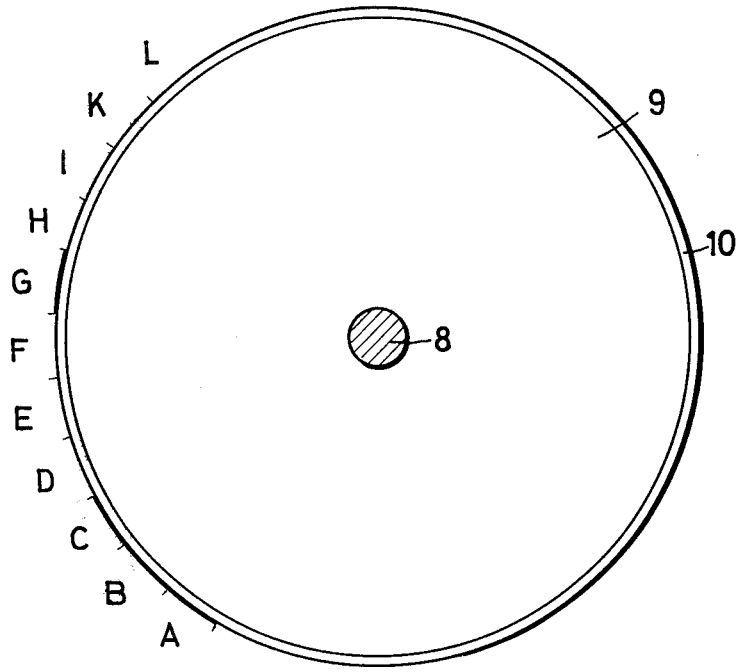
FIG. 7 depicts the light-sensitive semiconductor surface with the sections which are not discharged being explicitly indicated.

For example, assume that those of the switches 84 associated with the lines A, B and C in FIG. 7, and also the switches 93 and 94, are closed. The copies produced will each bear the lines A, B and C, and additionally one of the subsequent lines, with the additional line on successively produced copies corresponding to successive ones of the subsequent lines on the original. Due to the aforedescribed control of the copy sheet transport, adjoining lines on each copy will be separated from one another by only the normal line spacing, i.e., even though lines have been skipped relative to the sequence of lines on the original. The switch 45 depicted in FIGS. 1–6 is not required in the circuit arrangement shown in FIG. 8, because its function is absorbed into the operation of the lower unit of the sensing head 19.

It will be understood that each of the elements described above, or two or more together, may also find a useful application in other types of constructions and circuits differing from the types described above.

While the invention has been illustrated and described as embodied in particular types of copying apparatuses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A xerographic or electrostatic copying apparatus capable of effecting the copying of only selected lines, paragraphs or other such sections of an original to be copied, the copying apparatus comprising, in combination, means provided with a light-sensitive surface; means for illuminating the original to be copied and producing upon the light-sensitive surface an electrostatic image of the original; selector means operable in a plurality of different settings for selecting for copying different respective lines, paragraphs or other such sections of the original; and means, in addition to the means illuminating the original and producing the electrostatic image, automatically operative for electrostatically blanking out that portion of the light-sensitive surface corresponding to the non-selected sections of the original, the means for illuminating the original and producing the electrostatic image comprising means for projecting light from the illuminated original onto successive portions of the light-sensitive surface along a predetermined light path, the means for effecting the electrostatic blanking out comprising means for introducing additional light into the predetermined light path during those time intervals during which the means for projecting light from the illuminated original onto the light-sensitive surface is projecting light onto the sections of the light-sensitive surface corresponding to the non-selected sections of the original, the means for projecting light from the illuminated original onto successive portions of the light-sensitive surface along the predetermined light path including a semi-transmissive mirror positioned to reflect light from the illuminated original towards the light-sensitive surface along the predetermined path, the means for introducing additional light into the predetermined path comprising a light source located behind the semi-transmissive mirror and operative for emitting light through the semi-transmissive mirror and into the predetermined light path.

* * * * *